US010181247B2

(12) United States Patent
Allen et al.

(10) Patent No.: US 10,181,247 B2
(45) **Date of Patent: *Jan. 15, 2019**

(54) SYSTEM AND METHOD FOR IMPACT PREDICTION AND PROXIMITY WARNING

(71) Applicant: Elwha LLC, Bellevue, WA (US)

(72) Inventors: Paul G. Allen, Mercer Island, WA (US); Philip V. Bayly, St. Louis, MO (US); David Lozoff Brody, St. Louis, MO (US); Alistair K. Chan, Bainbridge Island, WA (US); Jesse R. Cheatham, III, Seattle, WA (US); William David Duncan, Mill Creek, WA (US); Richard Glen Ellenbogen, Seattle, WA (US); Roderick A. Hyde, Redmond, WA (US); Muriel Y. Ishikawa, Livermore, CA (US); Jordin T. Kare, San Jose, CA (US); Eric C. Leuthardt, St. Louis, MO (US); Nathan P. Myhrvold, Medina, WA (US); Tony S. Pan, Bellevue, WA (US); Robert C. Petroski, Seattle, WA (US); Raul Radovitzky, Bedford, MA (US); Anthony Vinson Smith, Seattle, WA (US); Elizabeth A. Sweeney, Seattle, WA (US); Clarence T. Tegreene, Mercer Island, WA (US); Nicholas W. Touran, Seattle, WA (US); Lowell L. Wood, Jr., Bellevue, WA (US); Victoria Y. H. Wood, Livermore, CA (US)

(73) Assignee: Elwha LLC, Bellevue, WA (US)

( * ) Notice: Subject to any disclaimer, the term of this patent is extended or adjusted under 35 U.S.C. 154(b) by 17 days.

This patent is subject to a terminal disclaimer.

(21) Appl. No.: 15/158,979

(22) Filed: May 19, 2016

(65) Prior Publication Data

US 2016/0267763 A1 Sep. 15, 2016

Related U.S. Application Data

(63) Continuation of application No. 14/688,775, filed on Apr. 16, 2015, now Pat. No. 9,396,641, which is a (Continued)

(51) Int. Cl.
*G08B 21/04* (2006.01)
*G08B 3/10* (2006.01)
(Continued)

(52) U.S. Cl.
CPC ..... *G08B 21/0438* (2013.01); *G08B 3/10* (2013.01); *G08B 5/36* (2013.01); *G08B 6/00* (2013.01);
(Continued)

(58) Field of Classification Search
CPC ..... G08B 21/0438; G08B 3/10; G08B 5/36; G08B 6/00; G08B 21/0461; G08G 1/166
(Continued)

(56) References Cited

U.S. PATENT DOCUMENTS 6,992,592 B2 * 1/2006 Gilfix ..... A61H 3/061 235/375
7,741,962 B2 6/2010 Kalik
(Continued)

*Primary Examiner* — Jack K Wang
(74) *Attorney, Agent, or Firm* — Foley & Lardner LLP

(57) ABSTRACT

A system for predicting and warning of impacts includes a sensor located remote from a user and configured to acquire user data regarding motion of the user and object data regarding motion of the object; and a processing circuit configured to predict a potential impact between the user and the object based on the user data and the object data; and control operation of a user-wearable warning device to
(Continued)

provide a warning output to the user in advance of a predicted time of the potential impact.

31 Claims, 7 Drawing Sheets

Related U.S. Application Data continuation of application No. 14/600,541, filed on Jan. 20, 2015, now Pat. No. 9,384,645.

(51) Int. Cl.
*G08B 5/36* (2006.01)
*G08B 6/00* (2006.01)
*G08G 1/16* (2006.01)

(52) U.S. Cl.
CPC ..... *G08B 21/0446* (2013.01); *G08B 21/0461* (2013.01); *G08G 1/166* (2013.01)

(58) Field of Classification Search
USPC ..... 340/573.1
See application file for complete search history.

(56) References Cited

U.S. PATENT DOCUMENTS 7,934,983 B1 5/2011 Eisner
8,253,589 B2 8/2012 Grimm et al.
8,333,643 B2 12/2012 Eisner
8,554,495 B2 10/2013 Mack et al.
9,715,815 B2 * 7/2017 Verma ..... G01S 11/06
2003/0149530 A1 8/2003 Stopczynski
2005/0177929 A1 8/2005 Greenwald et al.
2007/0050114 A1 3/2007 Koike et al.
2008/0085686 A1 4/2008 Kalik
2010/0005571 A1 1/2010 Moss et al.
2011/0090093 A1 * 4/2011 Grimm ..... G01S 5/0072 340/901
2011/0124388 A1 5/2011 Eisner
2011/0179458 A1 7/2011 Eisner
2012/0223833 A1 9/2012 Thomas et al.
2012/0306642 A1 * 12/2012 Howard ..... A42B 3/046 340/539.11
2013/0060168 A1 * 3/2013 Chu ..... A42B 3/046 600/595
2013/0074248 A1 3/2013 Evans et al.
2013/0118255 A1 5/2013 Callsen et al.
2013/0141221 A1 6/2013 Oksanen et al.
2013/0178957 A1 7/2013 Eisner
2013/0311075 A1 * 11/2013 Tran ..... B60W 30/09 701/117
2014/0167986 A1 * 6/2014 Parada ..... G01C 21/365 340/905
2015/0035672 A1 * 2/2015 Housley ..... G08B 21/0275 340/539.13
2015/0173666 A1 6/2015 Smith et al.
2015/0371517 A1 * 12/2015 Daniels ..... G08B 21/02 340/686.6

* cited by examiner

SYSTEM AND METHOD FOR IMPACT PREDICTION AND PROXIMITY WARNING

CROSS-REFERENCE TO RELATED PATENT APPLICATIONS

This application is a continuation of U.S. patent application Ser. No. 14/688,775, filed Apr. 16, 2015, which is a continuation of U.S. patent application Ser. No. 14/600,541, filed Jan. 20, 2015, both of which are incorporated herein by reference in their entireties.

BACKGROUND

Individuals involved in activities such as athletics (e.g., football, hockey, etc.), motor vehicle operation (e.g., motorcycle riding, etc.), or other activities (e.g., bicycle riding, etc.) run the risk of being involved in impacts or collisions (e.g., between players during a football game, between a motor cycle operator and a motor vehicle, etc.). Immediately prior to the collision (e.g., 30 milliseconds or less prior to the collision), there is typically insufficient time for persons to react in a manner to as to be able to avoid or mitigate a collision that is otherwise about to occur.

SUMMARY

One embodiment relates to a system for predicting and warning of impacts, including a sensor located remote from a user and configured to acquire user data regarding motion of the user and object data regarding motion of the object; and a processing circuit configured to predict a potential impact between the user and the object based on the user data and the object data; and control operation of a user-wearable warning device to provide a warning output to the user in advance of a predicted time of the potential impact.

Another embodiment relates to a system for predicting and warning of impacts, including a warning device configured to be worn by a user and provide a detectable warning output to a user; and a processing circuit configured to receive user data regarding motion of the user, including a current orientation of the head of the user; receive object data regarding motion of an object; predict a potential impact between the user and the object based on the user data and the object data; and control operation of the warning device to provide the warning output to the user based on the object data and the user data, including the current orientation of the user's head relative to a location of the potential impact.

Another embodiment relates to a system for warning athletes of illegal athletic actions, including a warning device configured to be worn by a user and provide a detectable warning output to a user; and a processing circuit configured to acquire user data regarding motion of the user; acquire object data regarding motion of an object; predict a potential impact between the user and the object; and control operation of the warning device to provide the user with the warning based on determining a predicted condition of the potential impact exceeds a predetermined threshold regarding unacceptable actions of the user.

Another embodiment relates to an athlete impact warning system, including a warning device configured to be worn on the head of an athlete and provide a warning including at least one of an audible warning and a haptic warning to the athlete; a plurality of sensors configured to be worn by the athlete and acquire impact data regarding a potential impact between the athlete and an object; and a controller configured to control operation of the warning device to provide the at least one of an audible warning and a haptic warning to the athlete based on the impact data and a current orientation of the head of the athlete.

Another embodiment relates to a method for predicting and warning of impacts, including receiving user data regarding motion of a user; receiving object data regarding motion of an object; predicting a potential impact between the user and the object based on the user data and the object data; and controlling operation of a user-wearable warning device to provide a user-detectable warning output to the user in advance of a predicted time of the potential impact.

Another embodiment relates to a method for predicting and warning of a potential impact, including receiving user data regarding motion of a user, including a current orientation of the head of the user; receiving object data regarding motion of an object; predicting a potential impact between the user and the object based on the user data and the object data; and controlling operation of a user-wearable warning device to provide a user-detectable warning output to the user based on the object data and the user data, including the current orientation of the user's head relative to the potential impact.

Another embodiment relates to a method for predicting and warning of a potential impact, including receiving user data regarding motion of a user, including a current orientation of the head of the user; receiving object data regarding motion of an object; predicting a potential impact between the user and the object based on the user data and the object data; and controlling operation of a warning device to provide the user with a user-detectable warning based on determining predicted conditions of the potential impact satisfy predetermined conditions regarding unacceptable actions of the user.

Another embodiment relates to a proximity sensing and warning system, including a sensor configured to acquire proximity data regarding the proximity of a user to an object; a user-wearable warning device provided on a protective pad configured to be worn on a body portion of the user; and a processing circuit configured to control operation of the warning device based on the proximity data to provide a warning to the user indicating at least one of a distance between the user and the object and a direction from the user toward the object.

Another embodiment relates to a proximity sensing and warning system, including a processing circuit configured to receive first proximity data regarding a proximity of a user to an object; control operation of a wearable warning device to provide an output to the user based on the first proximity data, the output including an indication of the proximity of the user to the object; receive second proximity data regarding a change in the proximity of the user to the object; and control operation of the warning device to provide a modified output to the user based on the second proximity data, the modified output including an indication of the change in proximity of the user to the object.

Another embodiment relates to a directional indicator system, including a remote device configured to provide data regarding a desired movement of a user; a wearable output device configured to be worn by the user and configured to provide an indication including at least one of a haptic indication and a visual indication to a user; and a processing circuit configured to receive the data and control operation of the output device to indicate the desired movement of the user.

Another embodiment relates to a method of predicting and warning of impacts, including receiving user data regarding a user and object data regarding an object; providing a warning to the user according to a first protocol based on the user data and the object data; receiving impact data regarding an actual impact between the user and the object; and generating a second protocol different from the first protocol for use in providing future warnings based on the impact data and the first protocol.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
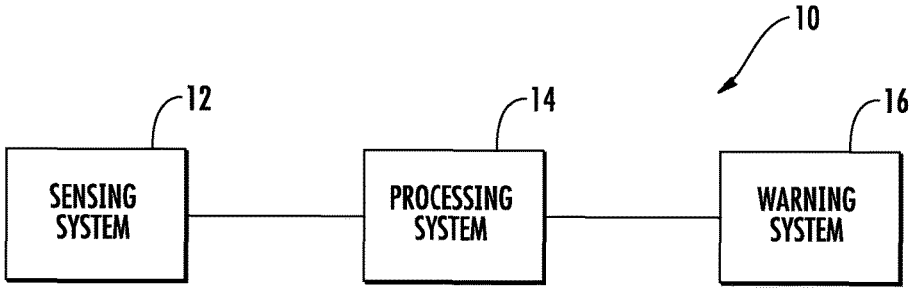
FIG. 1 is a block diagram of an impact warning system for users according to one embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the Figures generally, various embodiments disclosed herein relate to impact warning systems and methods intended to predict collisions or impacts, and provide various types of warnings regarding such impacts to users of the system. When an impending impact is within, for example, 30 milliseconds from occurring, sensor predictions of such impacts are generally accurate (e.g., due to the proximity of the impacting bodies), but users are not able to make decisions or take any corrective action to avoid any such predicted collisions or impacts. However, when an impending impact is, for example, 300 milliseconds from occurring, sensor predictions of such impacts may become less certain, and users may have time to make decisions and take corrective action to avoid such collisions, if desired.

Athletes such as football players are involved in impacts as part of playing the sport. However, players are not always aware of impending impacts with other players, the ground or a wall, a ball, etc., due to limitations of field of vision, player distractions, etc. The systems disclosed herein in accordance with various embodiments provide players with advance warning (e.g., audible, haptic, visual, etc.) regarding potential impacts involving the user. The warning may be generated based on various data regarding the user, other users, a surrounding area, etc., and may be provided so as to provide an indication of a distance to a potential impact, a time until a potential impact, a direction toward a potential impact, a velocity of an impacting object (e.g., another player, the ground, etc.), and the like.

Similarly, motor vehicle operators such as motorcyclists, bicyclists, and other users may likewise use the systems disclosed herein. For example, motorcyclists and/or bicyclists are not always aware of the activities of other drivers, the presence of various obstacles, or other objects that may pose a risk of impact. The systems disclosed herein in accordance with various embodiments are configured to provide motorcyclists, bicyclists, or other users of the system with advance warning of potential impacts, thereby potentially reducing the risk of injuries due to such impacts.

Referring now to FIG. 1, system 10 (e.g., an impact prediction and warning system, a proximity warning system, etc.) is shown according to one embodiment, and includes sensing system 12 and warning system 16. In general terms, sensing system 12 is configured to acquire various types of data regarding users of system 12, a surrounding environment, etc. Sensing system 12 may include user-wearable sensors, area sensors (e.g., sensors positioned at specific locations about an area such as a playing field, a street, etc.), and remote sensors such as cameras and the like. Sensing system 12 provides sensor data (e.g., user data, area data, etc.) to processing system 14.

Processing system 14 receives data from sensing system 12 and is configured to predict one or more potential impacts involving a user of system 10. For example, processing system 12 may predict a potential impact between multiple users (e.g., between two football players), between a user and one or more obstacles (e.g., the ground, a wall, a vehicle, etc.), etc. Processing system 14 controls operation of warning system 16 based on the sensor data and/or the prediction of a potential impact regarding the user. Processing system 14 may provide indications related to a direction/distance to a predicted impact, a time until impact, a speed, direction, velocity of an impacting body (e.g., another player), and the like. In one embodiment, the direction of a potential impact can be determined as the current direction between the user and the object. In another embodiment, the direction of a potential impact can be predicted based on extrapolation of the current relative positions and velocities of the user and the object (e.g., the direction to the point of the predicted closest approach between the object and the user). In some embodiments, processing system 14 is further configured to determine the proximity of a user to one or more objects and/or whether the relative distance, velocity, acceleration, etc. between the user and an object (e.g., a separation distance, etc.) is increasing, decreasing, or otherwise changing or remaining constant.

Warning system 16 is configured to provide one or more warnings to users of system 10. In various alternative embodiments, warning system 16 provides user-detectable warnings such as audible warnings, haptic warnings (e.g., vibratory warnings, etc.), visual warnings, etc. The warnings are configured to indicate direction, range, velocity, etc. relative to another user, a time until impact, and the like. The warnings can be provided relative to a current orientation of a user's head or body (i.e., rather than based on another exterior frame of reference, etc.), and may dynamically change to accommodate changes in the orientation of the user's head or body (e.g., relative to the impact and/or the user's torso, etc.). The warnings may further change based on a change in time until impact, relative distance, direction, velocity, acceleration between a user and an object/another user (e.g., to indicate a change in distance between two players, a change in a direction between two players, etc.).

Figure 2:
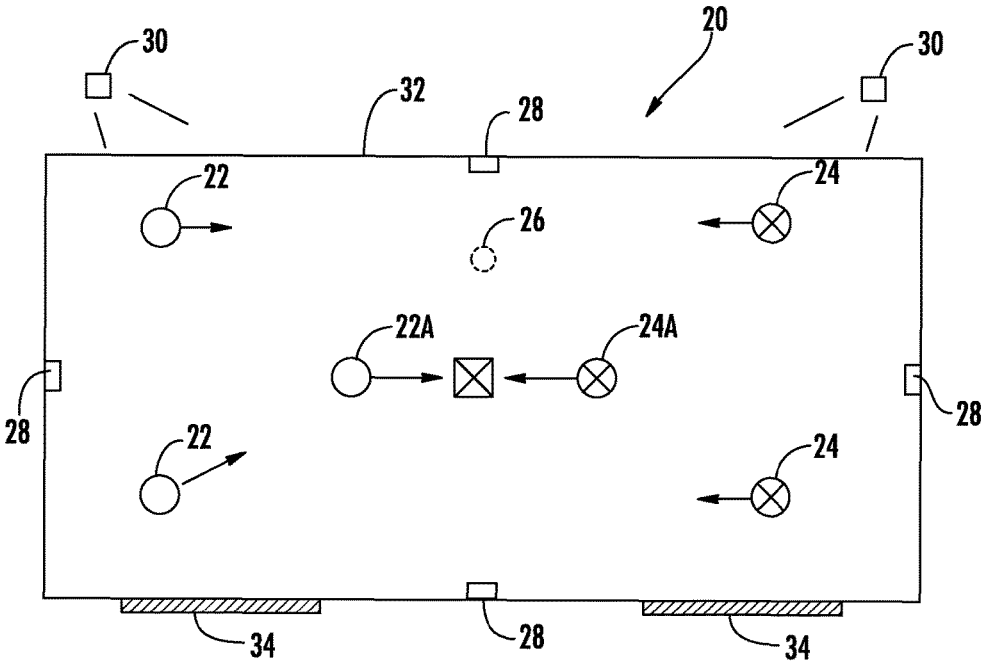
FIG. 2 is a schematic illustration of a number of users in an area according to one embodiment.

Referring now to FIG. 2, area 20 usable in connection with system 10 is shown according to one embodiment. As shown in FIG. 2, area 20 includes a ground surface 32 upon which various users, such as users 22, 24 (e.g., football players, motor vehicle operators, bicyclists, etc.) are moving. In some embodiments, users 22, 24 are participating in an athletic event (e.g., a football game, hockey game, baseball game, etc.). involving a ball 26 (e.g., a football, baseball, hockey puck, etc.) or similar type of equipment that may move within area 20. Area 20 may in some embodiments further include one or more wall portions 34 (e.g., obstacles, walls, buildings, parked cars, etc.).

In one embodiment, area 20 includes one or more area sensors 28 (e.g., remote sensors). Area sensors 28 may include any suitable sensors configured to detect the position, movement (e.g., velocity, acceleration, etc.), identity (e.g., team affiliation, etc.), etc. of various users 22, 24 or other objects. Area sensors 28 are positioned around or within area 20, and configured to acquire various data regarding area 20 and users 22, 24. In some embodiments, one or more remote sensors 30 (e.g., remote cameras, etc.) are further utilized to acquire data regarding area 20. As discussed in further detail below, additional sensors may be worn by users 22, 24 (e.g., as part of a head protection device, torso protection device, leg protection device, one or more head, wrist or ankle bands, as part of a team uniform, etc.) and used to acquire data regarding various users, objects, or a surrounding area.

The various sensors acquire data regarding users 22, 24, object 26, and/or area 20 and provide the data to processing system 14. Processing system 14 is configured to predict one or more potential impacts based on the data received from the various sensors. For example, referring further to FIG. 2, users 22A and 24A are shown to be travelling toward one another. As such, based on sensor data from sensing system 12, processing system 14 is able to predict a potential impact between users 22A, 24A. In one embodiment, the prediction is based on data regarding user 22A, data regarding user 24A, data regarding object 26, data regarding area 20, and/or additional data, such as threshold requirements for providing warning indications to users, rules of play for various sports, etc. Based on the predicted impact and associated data, processing system 14 controls the operation of one or more warning modules of warning system 16 to warn one or both of players 22A, 24A of the potential impact. As noted in greater detail below, the warning may be haptic, audible, and/or visual, etc., and may provide various indications related to a potential impact involving a user, including a time to impact, a direction of impact, a distance to impact, a distance to, velocity of, or direction to another user, closing speed, and so on. It should be noted that the teachings herein related to sensing movement of and providing warnings to users 22A, 24A are equally applicable to various embodiments involving only a single user (e.g., user 22A) and an inanimate object (e.g., object 26, etc.).

Figure 3:
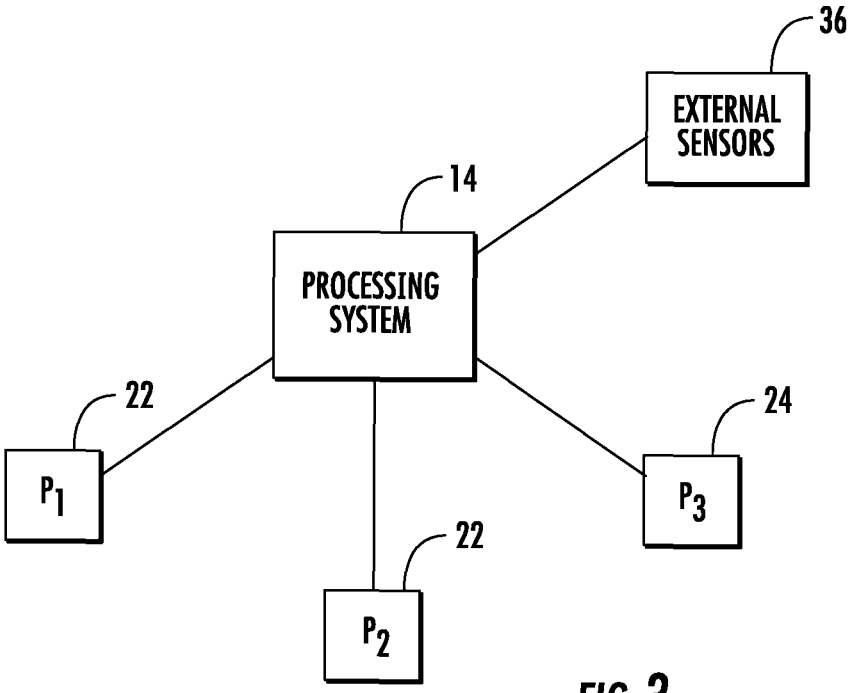
FIG. 3 is a block diagram illustrating communication between users and a processing system of an impact warning system according to one embodiment.
Figure 4:
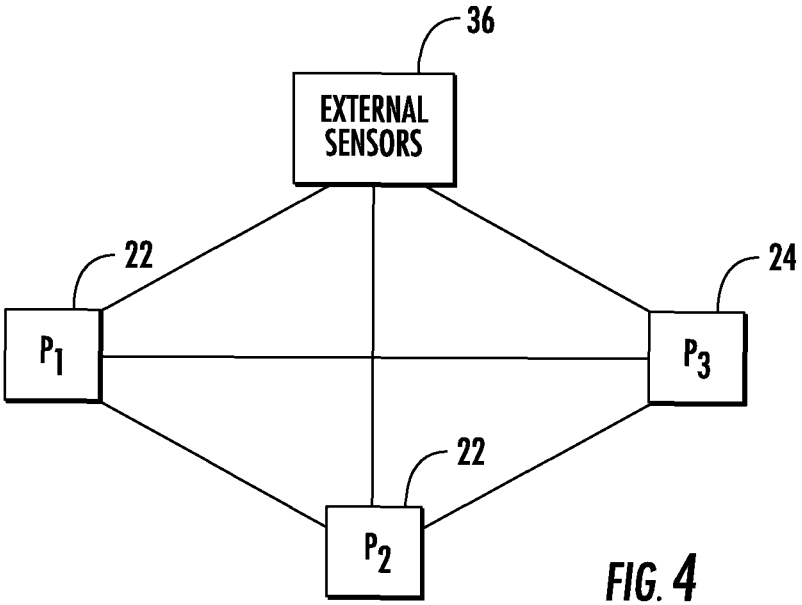
FIG. 4 is a block diagram illustrating communication between users of an impact warning system according to one embodiment.
Figure 5:
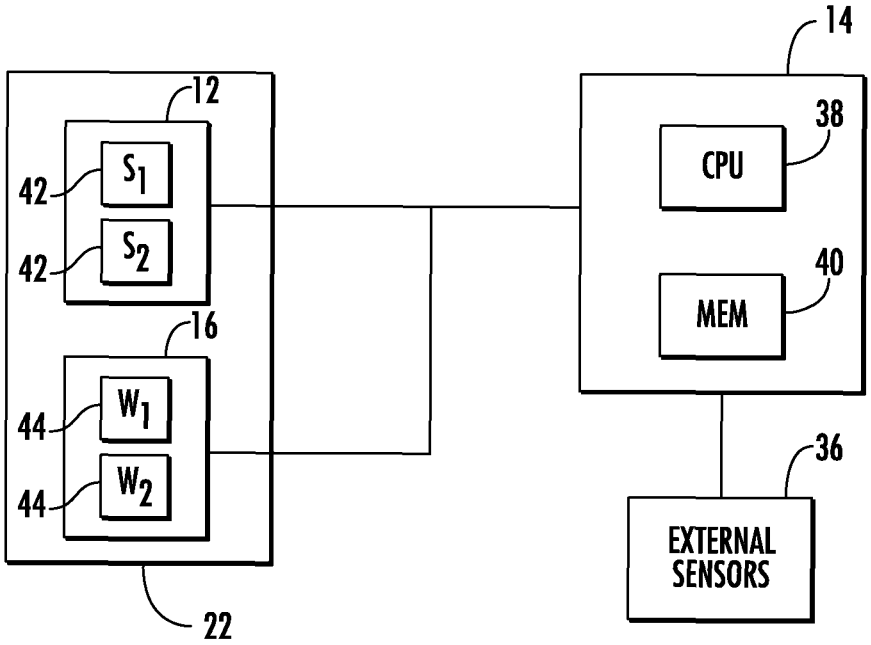
FIG. 5 is a block diagram of the impact warning system of FIG. 1 shown in greater detail according to one embodiment.

Referring now to FIGS. 3-5, users 22, 24, processing system 14, and/or one or more external sensors 36 may communicate with each other in a variety of ways, using any suitable wired and/or wireless communications protocols. Users 22, 24 generally include one or more sensors 42 and one or more warning modules 44 (see, e.g., FIG. 5). Processing system 14 is in one embodiment implemented as a remote processing system configured to communicate with one or more users 22, 24 (e.g., the corresponding sensing and warning systems). For example, referring to FIG. 3, each of players 22, 24 is configured to communicate with processing system 14, which is in turn configured to receive data from external sensors 36. External sensors 36 include any sensors external to users 22, 24 (e.g., sensors not worn by, carried by, or moving with the users, etc.), such as area sensors 28 and remote sensors 30 shown in FIG. 2. In other embodiments, processing system 14 is implemented into equipment worn, carried, or otherwise moving with users 22, 24, such that users 22, 24 can communicate directly with one another and/or external sensors 36. For example, as shown in FIG. 4, users 22, 24 communicate directly with each other and with external sensors 36 (e.g., via a local wireless communication protocol such as Bluetooth, etc.).

Based on the received data, processing system 14 controls operation of warning system 16. In one embodiment, warning system 16 is implemented by way of one or more warning modules 44 worn, carried by, or otherwise travelling with users 22, 24. Processing system 14 controls operation of one or more warning modules 44 based on predicting a potential impact (e.g., an impact between users 22A and 24 A shown in FIG. 2) or other data.

Referring to FIG. 5, user 22 and processing system 14 are shown in greater detail according to one embodiment. As shown in FIG. 5, user 22 may utilize sensor system 12 and warning system 16 and communicate with processing system 14 (e.g., via a suitable wireless communications protocol, etc.). Processing system 14 in turn may further communicate with external sensors 36. While system 10 is shown and described with respect to FIG. 5 to include a single user 22, it should be understood that in various alternative embodiments, system 10 includes multiple users (e.g., multiple users 22, 24). Each user 22, 24 may include portions of sensing system 12, processing system 14, and/or warning system 16.

Figure 6:
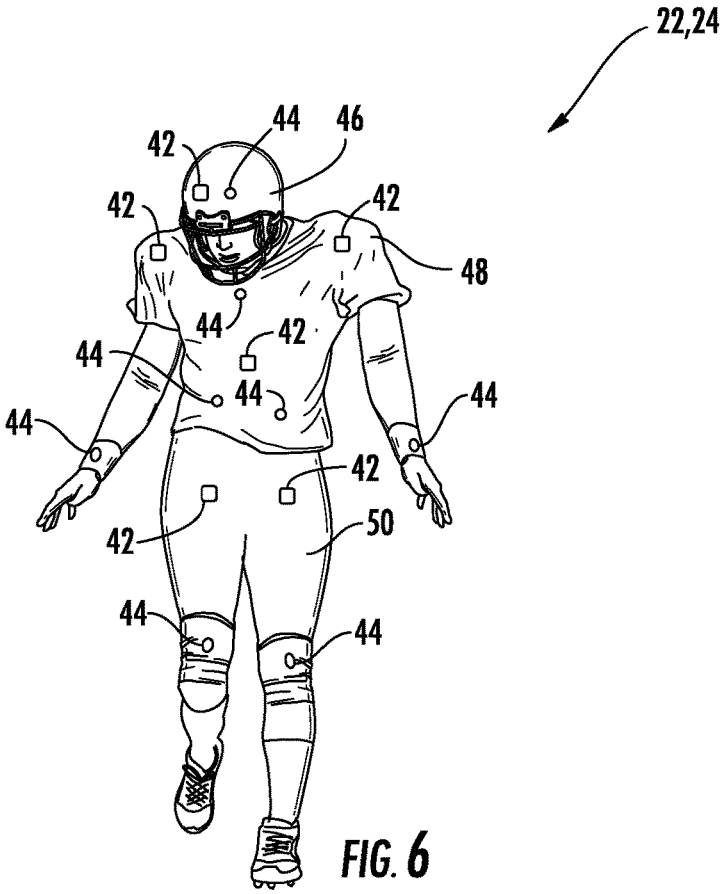
FIG. 6 is a schematic illustration of a user of an impact warning system according to one embodiment.

Referring further to FIG. 5, sensing system 12 includes a number of sensors 42. Sensors 42 acquire data regarding one or more users 22, 24, data regarding area 20, or other types of data usable by processing system 14 to predict potential impacts involving a user and provide suitable warnings of such impacts. As shown in FIGS. 6-7 and 9-10, sensors 42 are configured to be worn by, carried by, or travel with a user such as user 22. As shown in FIG. 6, sensors 42 are positioned at various locations about one or more pieces of equipment or clothing worn by user 22. In one embodiment, sensors 42 are provided in or on head protection device 46 (e.g., a helmet, etc.). In other embodiments, sensors 42 are provided in or on torso protection device 48 (e.g., shoulder pads, etc.). In further embodiments, sensors 42 are provided in or on leg protection device 50 (e.g., one or more pads, etc.). In some embodiments, rather than on a protection device, sensors 42 are provided on one or more articles of clothing, such as a shirt, pants, head or wrist band, etc.

Sensors 42 may be or include a wide variety of sensors configured to acquire various types of data regarding one or more users, an area, and the like. For example, in one embodiment sensors 42 are configured to acquire user data regarding a user wearing sensors 42. The user data may include a position of the user, an acceleration and/or velocity of the user, positions and/or orientations of various body parts of the user, and so on. In some embodiments, sensor 42 is configured to acquire user data regarding other users or objects (e.g., in addition to or rather than the user wearing sensors 42). The user data may include a position of another user, an acceleration and/or velocity of the other user, positions and/or orientations of various body parts of the other user, and so on. In addition, various data may be obtained in absolute terms (e.g., position, velocity, acceleration) and transformed into relative terms for two or more users or for a user and an object (e.g., by comparing absolute values of various users). Relative velocity between a user and an object can be split into closing speed (i.e., the component of relative velocity along the direction between the user and object, thereby denoting the rate of change of the spacing between them) and lateral velocity (i.e., the component of relative velocity perpendicular to the direction between the user and object, thereby related to the rate of change of the direction between them). In some embodiments, warnings related to closing speed are dependent upon its sign (e.g., warning is issued if the user and object are approaching each other, but not if they are receding from each other).

In one embodiment, sensor 42 is or includes an inertial sensing device, such as an accelerometer, a gyroscope, and the like. In other embodiments, sensor 42 is or includes an image capture device, such as a still image and/or video camera. In further embodiments, sensor 42 includes a GPS receiver, or a receiver of local time or position reference signals. In addition to such passive sensors, sensor 42 may in some embodiments be or include an active sensor, such as a lidar system, radar system, sonar system (e.g., an ultrasonic sonar or sensing system), a beacon for detection by external positioning system sensors, etc.

Figure 7:
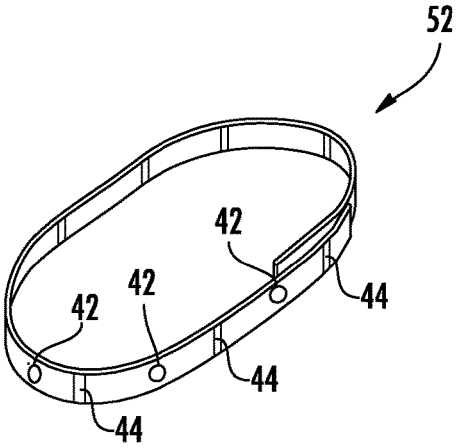
FIG. 7 is an illustration of a band usable to provide one or more warning modules of an impact warning system according to one embodiment.
Figure 9:
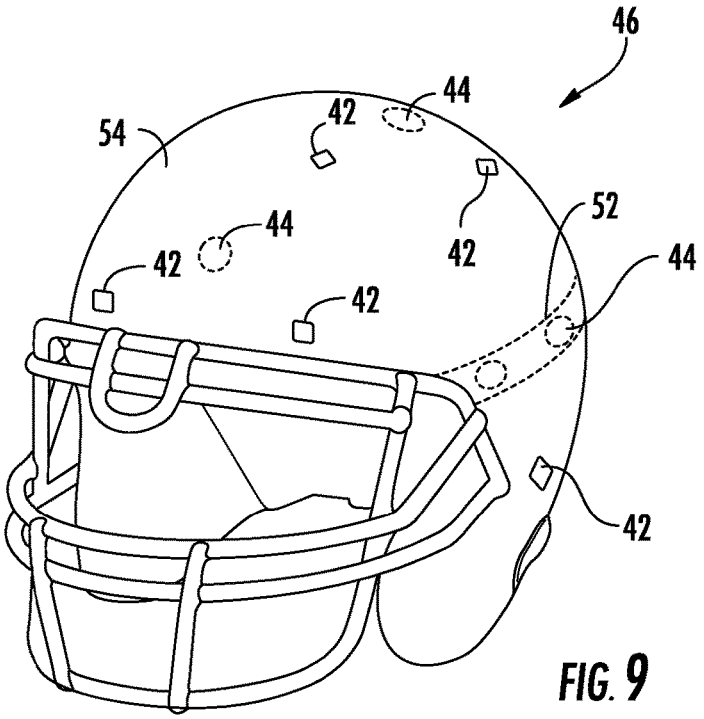
FIG. 9 is an illustration of a head protection device for an impact warning system according to one embodiment.

In one embodiment, sensors 42 are configured to determine an orientation of a user's head (e.g., a direction in which the user is facing, a tilt of the head relative to horizontal, etc.) or body. As such, sensors 42 may be spaced apart about the user's head to form a sensor array configured to acquire positional data regarding the orientation of a user's head. One embodiment of a sensor array is shown in FIG. 9, where a number of sensors 42 are spaced apart about shell 54 of helmet 46. In another embodiment, as shown in FIG. 7, sensors 42 are spaced apart about the circumference of band 52, which may be worn about the user's head. According to various other embodiments, sensors 42 may be used in different locations of a user.

Figure 10:
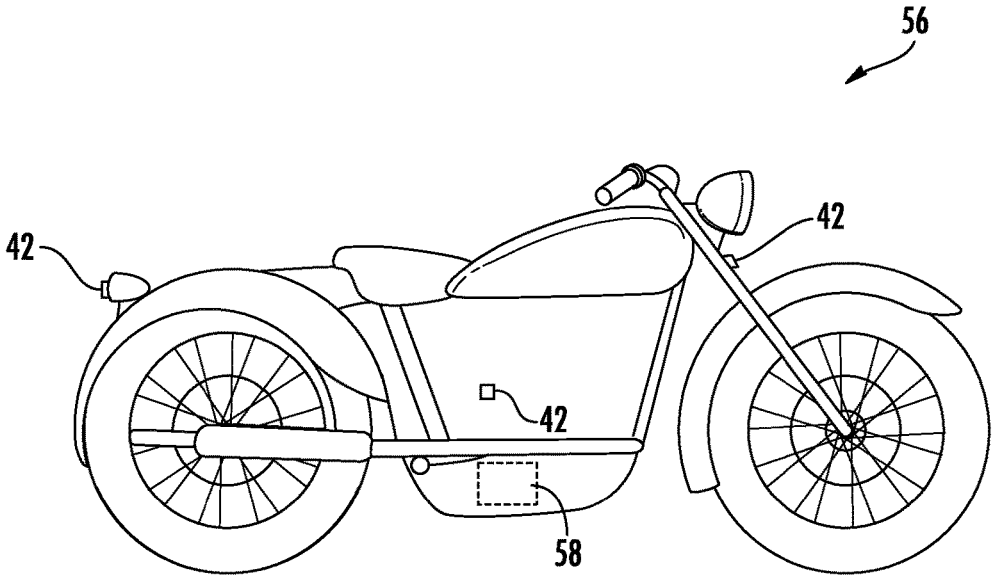
FIG. 10 is a schematic illustration of a vehicle usable with an impact warning system according to one embodiment.

In some embodiments, system 10 is implemented as part of a vehicle operator system, such that one or more sensors 42 are provided as part of a vehicle. For example, as shown in FIG. 10, vehicle 56 (e.g., a motorcycle, bicycle, etc.) includes one or more sensors 42 configured to provide sensor data to processing system 14. Furthermore, vehicle system 58 (e.g., a vehicle computer or control system, etc.) may be configured to provide additional data regarding operation of the vehicle, such as information regarding velocity, acceleration, braking conditions, and the like. A user (e.g., a motorcycle operator or bicycle rider) may wear a head protection device such as head protection device 46 (e.g., helmet such as a football, baseball, or hockey helmet, a motorcycle or bicycle helmet, a soldier helmet, a ski helmet, etc.) configured to house additional sensors 42 and/or portions of processing system 14 and warning system 16.

Warning system 16 includes a number of warning modules 44. Each warning module 44 is configured to provide a user-detectable warning to a user of system 10. In one embodiment, the warning is audible. In another embodiment, the warning is haptic. In further embodiments, the warning is visual. In yet further embodiments, the warning is a combination of warning types, including one or more of audible, haptic, visual, and the like. As shown in FIG. 6, warning modules may be provided in or on head protection device 46, torso protection device 48, leg protection device 50, or combinations thereof. For example, in the case of a football player, warning modules 44 may be integrated into or coupled to a helmet, one or more pads (e.g., shoulder pads, torso pads, thigh or knee pads, etc.), various articles of clothing (e.g., a shirt or jersey, pants, head or wrist/arm band, etc.) or otherwise coupled to or carried by a user.

Figure 8:
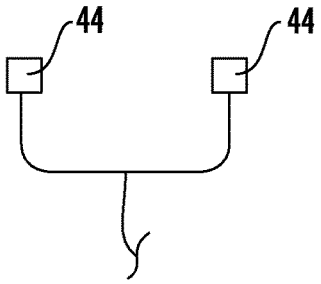
FIG. 8 is an illustration of warning modules for an impact warning system according to one embodiment.

In one embodiment, warning module 44 is or includes a speaker configured to provide an audible warning to a user. The speaker may be implemented in any suitable location, and any suitable number of speakers may be utilized. In some embodiments, multiple speakers may be utilized. For example, referring to FIG. 8, warning modules 44 are shown as a pair of speakers. The speakers may be worn near, on, or within one or both ears of a user. In one embodiment, the speakers are stereophonic such that a stereophonic warning is provided to users by way of warning modules 44. While in some embodiments the speakers are worn by a user (e.g., on an ear, etc.), in other embodiments, the speakers are carried by another piece of equipment, such as head protection device 46, a vehicle, etc.

The pitch, volume, and other characteristics of an audible warning may be varied to provide indications of speed, distance or proximity, direction, acceleration, time until impact, severity of impact, and the like. For example, a pitch of an audible warning may be increased or decreased with the relative velocity of an impacting body (e.g., another user or an object), and the volume of an audible warning may be increased/decreased with the relative distance between or proximity of potentially impacting bodies. As such, in one embodiment, as the relative velocity between two users increases and the distance between the users decrease, an audible warning may increase in pitch and/or volume. Conversely, should a user take action to avoid a potential collision (e.g., by slowing down, changing direction, etc.) to decrease the relative velocity between users and/or increase the distance between the users, the audible warning may decrease in pitch and/or volume.

In an alternative embodiment, warning modules 44 provide a haptic warning to a user. For example, warning module 44 may be or include a vibratory element configured to provide a haptic warning to a user regarding a potential impact. The frequency and/or amplitude of the vibrations may be varied to provide indications of speed, distance or proximity, direction, acceleration, time until impact, severity of impact, and the like. For example, a frequency of a vibratory warning may be increased or decreased with the relative velocity of an impacting body (e.g., another user or an object), and the amplitude of a vibratory warning may be increased/decreased with the relative distance between or proximity of potentially impacting bodies. As such, in one embodiment, as the relative velocity between two users increases and the distance between the users decrease, a vibratory warning may increase in frequency and/or amplitude. Conversely, should a user take action to avoid a potential collision (e.g., by slowing down, changing direction, etc.) to decrease the relative velocity between users and/or increase the distance between the users, the vibratory warning may decrease in frequency and/or amplitude.

In further embodiments, warning modules 44 provide visual warnings to users. For example, one or more lights (e.g., LEDs, etc.) may be provided within head protection gear (e.g., to the peripheral side of each eye, etc.). A brightness, color, blinking frequency, or other characteristic of the light may be varied to provide indications of speed, distance or proximity, direction, acceleration, time until impact, severity of impact, and the like. For example, a blinking frequency of a visual warning may be increased or decreased with the relative velocity of an impacting body (e.g., another user or an object), and the brightness of a visual warning may be increased/decreased with the relative distance between or proximity of potentially impacting bodies. As such, in one embodiment, as the relative velocity between two users increases and the distance between the users decrease, a visual warning may change color, or increase in blinking frequency and/or brightness. Conversely, should a user take action to avoid a potential collision (e.g., by slowing down, changing direction, etc.) to decrease the relative velocity between users and/or increase the distance between the users, the visual warning may change color, or decrease in blinking frequency and/or brightness.

Referring now to FIG. 7, band 52 is shown according to one embodiment. Band 52 includes one or more warning modules 44. In one embodiment, band 52 includes a single warning module 44. In other embodiments, band 52 includes a plurality of warning modules 44. In other embodiments, band 52 includes a distributed sound or vibration source, in which the spatial pattern of sound or vibrations can be varied along the band. In one embodiment, warning modules 44 are equally spaced about band 52. In other embodiments, warning modules 44 are selectively positioned along band 52 so as to correspond in location to desired parts of a user's body (e.g., an ear or temple area of the head, a wrist, etc.). The size of band 52 can be varied to fit various users and to accommodate various types of warning modules 44. In one embodiment, band 52 is a head band or other headgear (e.g., a hat, a helmet, a skullcap, etc.). In other embodiments, band 52 may be a wrist band (e.g., a watch, etc.), ankle band, a shirt, a webbing, or a band to extend about another portion of the user's body (e.g., torso, leg, arm, etc.).

In one embodiment, band 52 includes a plurality of audible warning modules 44. In an alternative embodiment, band 52 includes a plurality of haptic (e.g., vibratory, etc.) warning modules 44. In yet further embodiments, band 52 includes a combination of audible and haptic warning modules 44. In some embodiments, band 52 provides one-dimensional control features for providing warnings to users, such that warning modules 44 can be selectively activated and deactivated about the circumference of band 52 (e.g., along the one-dimensional length of the band). In other embodiments, band 52 provides two-dimensional control features for providing warnings to users, such that warning modules 44 can be selectively activated and deactivated at locations on band 52 (e.g., on the two-dimensional surface of the band).

According to one embodiment, warning modules 44 are configured to be selectively and dynamically activated and deactivated based on a direction to a predicted impact or proximate user/object relative to a current orientation of the user's head. Warning modules 44 provide directional cues as to the location of an object, another user, or a potential impact, and as the position of the user's head changes, different speakers can provide warnings to the user such that the warnings provide an indication of a direction to the object, other user, or potential impact taking into account the current orientation of the user's head. For example, referring to FIG. 7, warning modules 44 are spaced apart about band 52. Should a user rotate his or her head relative to the location of an object, other user, or a predicted impact, warning modules 44 may be selectively activated and deactivated along the length of the band as the user turns his or her head. In other embodiments, other ways of maintaining direction cues relative to the orientation of a user's head or body may be utilized. For example, a webbing with multiple warning modules can be worn on the user's torso, and provide directional warnings of a potential impact relative to the current orientation of the user's torso. For example, a warning module can be worn on each leg of a football player, and activation of the left leg's warning module rather than the right leg's one can warn of a potential impact to the left leg rather than the right leg.

Referring further to FIG. 5, processing system 14 includes processor 38 and memory 40. Processor 38 may be implemented as a general-purpose processor, an application specific integrated circuit (ASIC), one or more field programmable gate arrays (FPGAs), a digital-signal-processor (DSP), a group of processing components, or other suitable electronic processing components. Memory 40 is one or more devices (e.g., RAM, ROM, Flash Memory, hard disk storage, etc.) for storing data and/or computer code for facilitating the various processes described herein. Memory 40 may be or include non-transient volatile memory or non-volatile memory. Memory 40 may include database components, object code components, script components, or any other type of information structure for supporting the various activities and information structures described herein. Memory 40 may be communicably connected to processor 38 and provide computer code or instructions to processor 38 for executing the processes described herein.

As also disclosed elsewhere herein, processing system 14 may take various types of data into account in predicting and providing warnings of potential impacts involving users and/or the proximity of other users, objects, etc. In one embodiment, processing system receives user data for a user and object data for an object. The user may be, for example, one of users 22, 24. The object may be, for example, another of users 22, 24 (whether or not they are equipped with similar warning modules), a stationary object in the user's environment, such as ground surface 32, wall surface 34, etc., a ball or other piece of equipment being used by the user, such as ball 26, a vehicle, and so on.

A potential impact between the user and the object is in one embodiment predicted based on relative location, velocity, and/or acceleration data. For example, based on data received from various sensors, the absolute location, velocity, and/or acceleration data for the user and the object may be determined by processing system 14. Processing system 14 may in turn determine relative distances, velocities, and/or accelerations to predict potential impacts (e.g., based on whether two objects are close to each other and headed toward a common point).

As noted above, in addition to position, velocity, and acceleration data for each user, the various sensors may further provide data indicating an orientation of each user or object. Based on determining the orientations of user and objects, processing system 14 can further determine whether a potential impact is within a field of view of one or more players, such that the player would be more or less likely to be aware of the potential impact. In some embodiments, the orientation of specific body parts may be utilized. For example, a user's field of vision and hearing is in part dictated by the orientation of the user's head. As such, processing system 14 may further take data such as the orientation of the user's head or other body parts into account.

In some embodiments, a potential impact is predicted further based on team affiliations of one or more users. For example, during a football game, two users of system 10 may be more likely to collide if they are on opposing teams rather than on the same team. As such, sensors 42 may be configured to provide data regarding team affiliations of various users. For example, sensors 42 in some embodiments are or include RFID tags that may be carried by each user. The RFID tags may provide team affiliation data, and may provide user-specific data, such as a user height, weight, etc. Further, in some embodiments, impact histories for users may be accessible by way of the RFID tags, and may indicate the number of past impacts for each user, the severity of the impacts, whether the impacts included penalties (e.g., as part of an athletic game, as part of a traffic violation, etc.).

In further embodiments, a potential impact is predicted based on area data regarding an area in which users 22, 24 travel. Area data may be acquired by sensors 42 carried by users 22, 24, by external sensors 36 (e.g., area sensors 28 and/or remote sensors 30), or from other sensors. Furthermore, in some embodiments, area data is stored in memory (e.g., memory 40) and may include data regarding specific areas (e.g., a playing field size, street dimensions, obstacles within an area, etc.).

In yet further embodiments, processing system 14 acts as a proximity warning system configured to provide indications of nearby objects or other users, such as indications of relative position (e.g., distance and direction, etc.), velocity (e.g., closing speed), time until potential impact, and/or acceleration of the nearby objects or users. Furthermore, processing system 14 may determine and provide indications of changes in (or rates of changes in) relative positions, velocity, acceleration, impact times, and the like. For example, in the context of a sporting event such as a football game, processing system 14 may be configured to provide indications of separation between players, such that, for example, a player (e.g., an offensive player with the ball) running down the field receives indication of whether the separation between the offensive player and one or more defenders is increasing, decreasing, changing in direction, and so on.

Processing system 14 controls operation of warning system 16 and warning modules 44 based on the various types of data. In one embodiment, processing system 14 controls warning system 16 to provide user with an indication of one or more of a direction to a potential impact, a distance to a potential impact, a time to a potential impact, a velocity, closing speed, or acceleration of an impacting body, a severity of a potential impact (e.g., based on relative momentums of impacting bodies, etc.), and the like. In other embodiments, similar indications can be provided for nearby, but not necessarily impacting, objects, users, etc. In various embodiments, processing system 14 selectively and dynamically activates, deactivates, and modifies the output of various warning modules 44 to provide such indications.

In one embodiment, warning modules 44 are spaced about one or more portions of a user's body, and processing system 14 controls operation of the warning modules such that those warning modules in the direction of a potential impact are activated, or alternatively, provide a more intense (e.g., louder, brighter, etc.) warning. As shown in FIGS. 6-9, directional warnings can be provided at various portions about a user's body (see FIG. 6), along a one-dimensional length of a band (see FIG. 7), as a stereophonic warning (FIG. 8), about a two dimensional warning module array spaced about the periphery of a user head protection device or other piece of equipment, and so on.

In one embodiment, processing system 14 is configured to further control the operation of warning modules based on a predicted condition of a potential impact exceeding a predetermined threshold (e.g., a threshold based on rules of play, traffic regulations, or similar data so as to provide warning to users regarding illegal play (e.g., in the case of sporting events) or activities (e.g., in the case of motor vehicle operation, etc. For example, processing system 14 may be configured to provide a warning to users during an athletic event (e.g., during a football game) based upon determining that a predicted action of the user will result in a penalty, fine, etc. Similarly, processing system 14 may provide a warning to user of motor vehicles that a predicted action may result in a traffic violation. The warning may be audible (e.g., "Don't do it"), visual (e.g., a red or warning light), haptic (e.g., a vibration, etc.), or a combination thereof. A severity of a penalty or fine may be encoded into the warning (e.g., via the pitch/volume of an audible warning, the frequency/amplitude of a vibratory warning, the blinking frequency/brightness of a visual warning, etc.). Processing system 14 may document the warning (e.g., by storing it, or transmitting it to a third party); this documentation may include the warning provided to the user, the time of the warning, the predicted time of the impact, the time interval between the warning and the predicted impact, the user data, the object data, the predicted condition, and a comparison between the predicted condition and the predetermined threshold.

In further embodiments, processing system 14 is configured to take various thresholds into account in controlling the operation of warning system 16 and warning modules 44. For example, processing system 14 may take into account minimum relative velocity, closing speed, or acceleration, a maximum distance between impacting bodies, time until impact, a minimum severity of a potential impact (e.g., as determined by relative momentum values, by mass or strength of the object, by impact location on the user, etc.), the inclusion of players from opposing teams in a potential impact, whether or not the object is within the user's field of view, etc. These thresholds may be stored in memory, and may configurable by a user. In some embodiments, system 10 is used as a training aid, during practice or preseason games, with less experienced players, etc., such that the sensitivity of the system can be increased or decreased so as to provide more or less warning to users. As such, as users develop familiarity with system 10 (and, potentially become a more skilled player, driver, etc.), the sensitivity of the system can be decreased to increase the accuracy of impact predictions, yet still provide users with sufficient time to take any necessary or desired corrective action.

While in various embodiments one or more warning devices are shown coupled to a helmet (e.g., a football helmet, a motorcycle helmet, etc.), as shown in various alternative embodiments, warning devices may be integrated with or coupled to various other components, including various protective pads (e.g., shoulder pads, torso pads, knee pads, etc.), articles of clothing (e.g., a jersey, pants, head, arm, leg, ankle, or wrist bands, etc.), and the like. As such, in some embodiments, by utilizing warning devices spaced apart on a user's body, directional indications can be provided by selectively certain warning devices (e.g., those corresponding to a direction of an incoming object or another user, etc.).

In one embodiment, the warning or proximity systems herein can provide a wide variety of indications to users, including indications of an impending impact (e.g., including indications of relative distance, direction, velocity, closing speed, time to impact, acceleration, etc.), proximity (e.g., including indications of relative distance, direction, velocity, closing speed, time to impact, acceleration, etc.), changes in relative direction, distance, velocity, closing speed, time to impact, acceleration, etc. (e.g., by modifying a warning output, etc.).

In further embodiments, processing system 14 is configured to provide warnings according to a warning protocol. For example, system 14 in one embodiment triggers one or more warnings based on a relative distance, velocity, closing speed, time to impact, and/or acceleration exceeding a threshold (e.g., according to a first protocol). Warning data regarding various characteristics of the provided warning (e.g., a timing, a volume, intensity, etc.) may be stored by processing circuit 14. Should an actual impact occur, impact data may be stored regarding the intensity of the impact on one or more users. Based on the warning data and the impact data, the warning protocol may be modified (e.g., to generate a second protocol) to provide more or less warning time, to increase or decrease the intensity of the warning, etc. The modified protocol may then be used to generate future warnings.

In yet further embodiments, rather than providing a warning of an impact or a proximity of another user or object, system 10 may be configured to enable a user to receive instructions from a remote source. For example, processing system 14 is in some embodiments configured to control operation of warning system 16 to provide indications of a desired direction, distance, velocity, body part, etc. to move. The directional indications may be provided based on signals received from a remote source. The indication may be provided in the form of an audible, haptic, visual, or other type of warning. For example, in the context of a sporting event such as a football game, a coach may utilize system 10 to provide control signals to a warning system 16 worn by a player to indicate that the player should move in a specific direction (e.g., forward, backward, left, right, etc.), a specific distance, how fast, move a specific body part, and the like. Any of the warning methods disclosed herein may be used to provide such types of directional indications according to various alternative embodiments.

Figure 11:
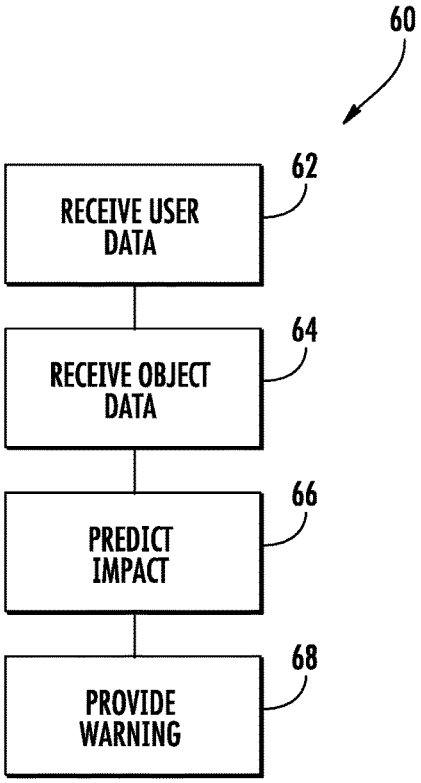
FIG. 11 is a block diagram of a method of using an impact warning system according to one embodiment.

Referring now to FIG. 11, method 60 of predicting impacts and providing warnings to users is shown according to one embodiment. User data is received (62). In one embodiment, a sensor system acquires user data regarding one or more users and provides the data to a processing system. Object data is received (64). The object may be an inanimate object (e.g., the ground, an obstacle, a ball, a vehicle, etc.) or alternatively, may be another person or user. In one embodiment, a sensing system acquires data regarding the object and provides the data to a processing system. In some embodiments, data regarding a plurality of objects may be acquired. An impact is predicted (66). Based on the user data and the object data, a potential impact is predicted by, for example, a processing system. Potential impacts may be predicted further based on additional data, including area data, stored user data (e.g., team affiliations, etc.). A warning is provided (68). In one embodiment, a processing system controls operation of a warning system to provide a user-detectable warning (e.g., a haptic, audible, and/or visual warning) to users regarding a potential impact. The warning may be encoded (e.g., via an intensity, frequency, amplitude, location on the user's body, etc.) to provide an indication of various characteristics of the potential impact, such as a time until impact, a distance to the impact, a direction of the impact, a speed, location etc., of an impacting body, and the like. Furthermore, the warning may change dynamically as the relationship between the potentially impacting bodies changes. It should be noted that in various alternative embodiments, warnings may be provided based on additional data, such as an orientation of a user's body, an orientation of a user's head, a field of vision of a user, and so on.

Figure 12:
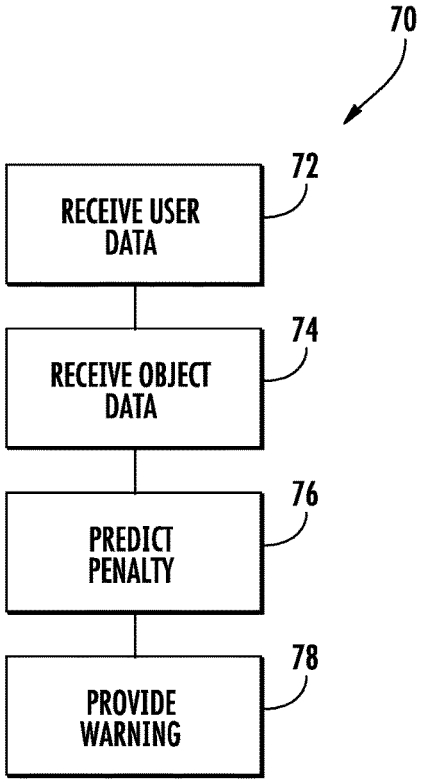
FIG. 12 is a block diagram of a method of using an impact warning system according to another embodiment.

Referring to FIG. 12, method 70 of predicting impacts and providing warnings to users is shown according to another embodiment. User data is received (72). In one embodiment, a sensor system acquires user data regarding one or more users and provides the data to a processing system. Object data is received (74). The object may be an inanimate object (e.g., the ground, an obstacle, a ball, a vehicle, etc.) or alternatively, may be another person or user. In one embodiment, a sensing system acquires data regarding the object and provides the data to a processing system. In some embodiments, data regarding a plurality of objects may be acquired. A penalty is predicted (76). Based on the user data and the object data, a potential impact is predicted by, for example, a processing system. Potential impacts may be predicted further based on additional data, including area data, stored user data (e.g., team affiliations, etc.). Based on predetermined rules of play or other regulations, a determination is made as to whether the potential impact will result in a penalty, fine, etc. for the user. A warning is provided (78). In one embodiment, a processing system controls operation of a warning system to provide a user-detectable warning (e.g., a haptic, audible, and/or visual warning) to users regarding a potential impact and associated penalty, fine, etc. The warning may be encoded (e.g., via an intensity, frequency, amplitude, location on the user's body, etc.) to provide an indication or various characteristics of the potential impact, such as a time until impact, a distance to the impact, a direction of the impact, a speed, location etc., of an impacting body, and the like. Furthermore, the warning may change dynamically as the relationship between the potentially impacting bodies changes. The warning may further provide an indication of the severity of the penalty, fine, etc. It should be noted that in various alternative embodiments, warnings may be provided based on additional data, such as an orientation of a user's body, an orientation of a user's head, a field of vision of a user, and so on.

Figure 13:
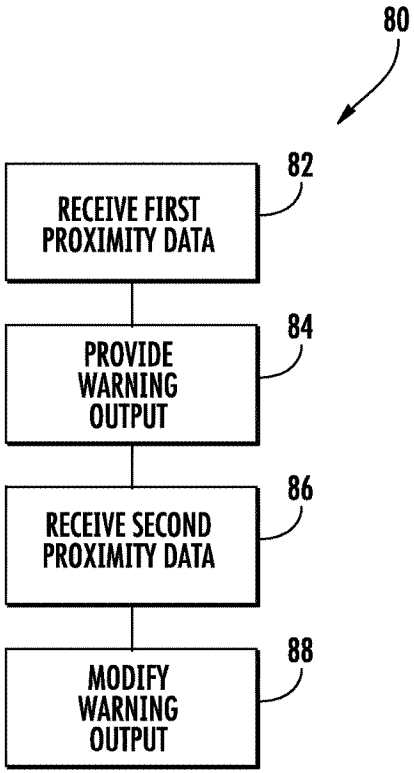
FIG. 13 is a block diagram of a method of using a proximity warning system according to one embodiment.

Referring to FIG. 13, method 80 of providing a proximity warning to users is shown according to one embodiment. First proximity data is received (82). The first proximity data may be provided by any of a variety of sensors such as those described herein, and may provide an indication of one or more of a relative direction, a relative distance, a relative velocity, a closing speed, time to impact, and a relative acceleration between a user and an object or other user. Based on the first proximity data, a warning is provided (84). The warning may be provided using any suitable warning device (e.g., visual audible, haptic, etc.), or a plurality of warning devices, and may provide an indication to a user of one or more of a relative direction, a relative distance, a relative velocity, a closing speed, time to impact, and a relative acceleration between the user and the object or other user. Second proximity data is received (86). The second proximity data may be provided in a similar manner to the first proximity data and include similar information. The second proximity data is received at a later time than the first proximity data. Based on the second proximity data, the warning is modified (88). In one embodiment, the warning is modified to provide an indication of a change in one or more of a relative direction, a relative distance, a relative velocity, a closing speed, time to impact, and a relative acceleration between the user and the object or other user. Proximity data may continue to be received such that the warning may be modified on an intermittent or substantially continuous basis to provide an indication of a relative direction, a relative distance, a relative velocity, a closing speed, time to impact, or a relative acceleration between the user and the object or other user, or changes therein. As a practical embodiment, a football player may be running with a football with one or more defenders in pursuit. Based on proximity data regarding the player and defenders, a warning output may be provided and subsequently modified to indicate, for example, whether a separation distance is increasing or decreasing, whether an angle of attack of one or more defenders is changing, and the like. As such, a player who increases a separation distance to a sufficient extent may be able to run at a slightly slower pace to avoid injury, conserve energy, etc.

Figure 14:
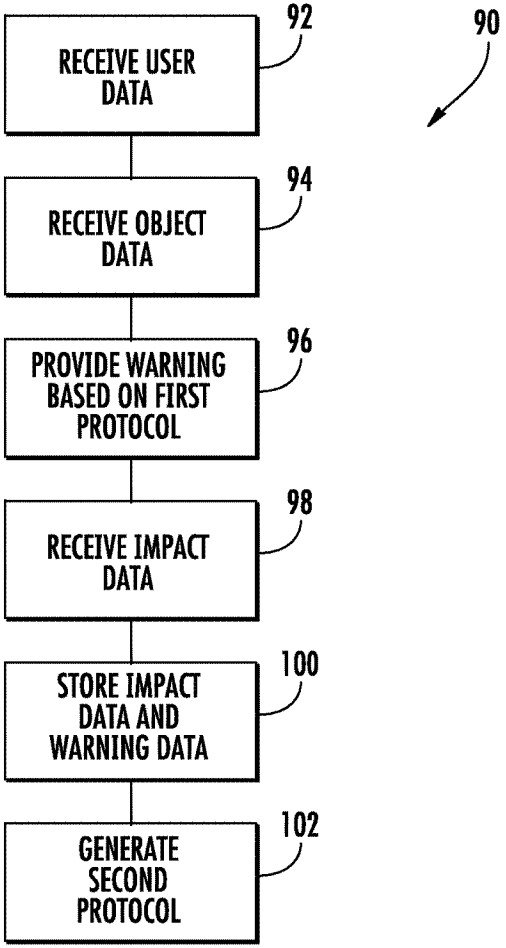
FIG. 14 is a block diagram of a method of generating protocols for use in warning systems according to one embodiment.

Referring to FIG. 14, a method of updating warning protocols is shown according to one embodiment. User data is received (92) and object data is received (94). The user data and the object data may include any of the data described herein, and may provide indications of relative direction, distance, velocity, acceleration, etc., between the user and the object (e.g., an inanimate object or another user, etc.). Based on the user data and the object data, a warning is provided according to a first warning protocol (96). In one embodiment, the warning is provided based on a value (e.g., a value corresponding to a distance, velocity, acceleration, etc.) exceeding or satisfying a threshold value. The warning protocol may define one or more such thresholds, along with a type, timing, etc. of a warning to be provided. Should an actual impact occur, impact data regarding the impact is received (98). The impact data may be received from any of a number of sensors, and may be stored for further use along with warning data regarding the type, timing, etc. of the warning (100). A second warning protocol is generated (102). The second warning protocol may be generated based on any or all of the user data, the object data, the impact data, the warning data, and the first protocol. Generating the second protocol in some embodiments includes modifying the first protocol to change a type of warning, a timing of warning, and/or one or more threshold values. Other modifications may be made between the first protocol and the second protocol according to various alternative embodiments. Any of this data may be stored for use in providing future earnings and/or determining the impact of using a warning system (e.g., by identifying reductions in impact forces to the head, etc.). Modifying the warning protocol may be done on a per-user basis to customize warning protocols for each user.

In some embodiments, in addition to the features discussed elsewhere herein, one or more notifications may be provided (e.g., by way of sensing system 12, processing system 14, and warning system 16) regarding one or more events during, for example, an athletic event such as a football game, etc. Generally, processing system 14 receives event data regarding an event. The event may include various types of events in athletic or other events. For example, in the context of a football game, the event may include a player signaling for a fair catch, an official signaling that a play is dead, an official throwing a flag, etc. to signal a penalty and/or that one team may have a "free play" due the penalty, a period of play nearing an expiration of time, and the like. Processing system 14 receives event data from one or more sensors and/or input devices such as those disclosed herein. Based on the event data, processing system 14 controls operation of warning system 16 to provide an appropriate notification. For example, in connection with the various examples in the context of a football game, one or more players may be provided with an indication (e.g., an audible, haptic, visual, etc. indication) via one or more warning modules 44. The notification may provide an indication that players should stop play (e.g., in the case of certain penalties, in the case of the expiration of time of a time period, in the case of player injury, etc.), that one team may have a free play (in the case of certain penalties, etc.), and the like.

In some embodiments, notifications are selectively provided to a portion of users of system 10. For example, during an athletic event, warnings may be provided only to those players currently on a playing field or otherwise actively involved in the game. In other embodiments, notifications are provided based on team affiliation, player position (e.g., quarterback, etc.), or other factors. Such a configuration enables consistent notifications to be sent to players to end play, etc., such that unnecessary injuries may be avoided.

Figure 15:
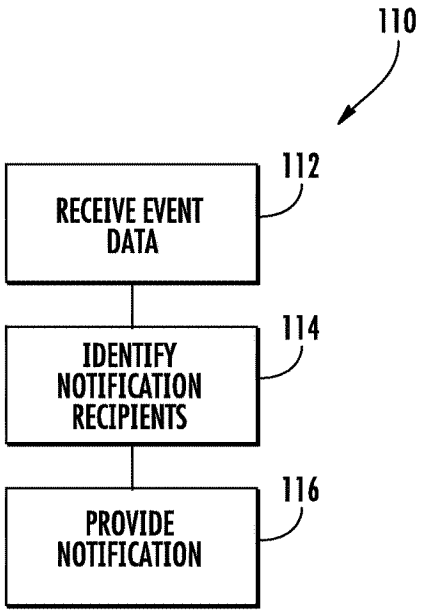
FIG. 15 is a block diagram of a method of providing a notification regarding an event according to one embodiment.

Referring now to FIG. 15, method 110 of providing event notifications is shown according to one embodiment. Event data is received (112). As noted above, event data may be received by way of a variety of input devices, sensors, and the like, including any components disclosed in connection with sensing system 12 or other portions of system 10. Recipients are identified (114). Notifications may be directed to less than all of the users of system 10, such that one or more recipients may be identified to receive the notification (e.g., based on whether a player is currently playing, based on team affiliation, based on player position, etc.). One or more notifications are provided to the recipients (116). The notifications may be audible, haptic, and/or visual, and may provide any of the notifications discussed herein.

It should be noted that in processing system 19 and processing circuit 14 are configured to receive, process, and act upon the various data types disclosed herein very rapidly (e.g., in real time, etc.). As such various methodologies, algorithms, processing techniques, computer models, etc. may be used to implement the various embodiments disclosed herein For example, in some embodiments, processing circuit 14 may utilize heuristic algorithms, artificial intelligence/genetic programming algorithms, fuzzy logic, etc. Additionally, various deep learning architectures such as deep neural networks, convolutional deep neural networks, and/or deep belief networks may be utilized. Any of these methodologies, algorithms, models, etc. may be used, alone or in any suitable combination, according to any of the various embodiments disclosed herein.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A proximity sensing and warning system, comprising:

a sensor configured to generate proximity data regarding a non-contact proximity of a user to an object, wherein the sensor is positioned external to and does not move with the user;

a user-wearable warning device provided on a protective pad configured to be worn on a body portion of the user; and a processing circuit configured to receive the proximity data from the sensor and control operation of the user-wearable warning device prior to an impact between the user and the object based on the proximity data to provide a warning to the user indicating at least one of (i) a distance between the user and the object and (ii) a direction from the user toward the object.

2. The system of claim 1, wherein the processing circuit is configured to change a characteristic of the warning based on a change in at least one of the direction and the distance.

3. The system of claim 2, wherein the warning includes a vibratory warning and wherein the characteristic includes at least one of a frequency and an amplitude of the vibratory warning.

4. The system of claim 2, wherein the warning includes an audible warning, and wherein the characteristic includes at least one of a pitch and a volume of the audible warning.

5. The system of claim 2, wherein the warning includes a visible warning, and wherein the characteristic includes at least one of a brightness, a color, and a blinking frequency of the visible warning.

6. The system of claim 1, wherein the processing circuit is configured to change a characteristic of the warning based on a change in velocity of the object relative to the user.

7. The system of claim 6, wherein the warning includes a vibratory warning and wherein the characteristic includes at least one of a frequency and an amplitude of the vibratory warning.

8. The system of claim 6, wherein the warning includes an audible warning, and wherein the characteristic includes at least one of a pitch and a volume of the audible warning.

9. The system of claim 6, wherein the warning includes a visible warning, and wherein the characteristic includes at least one of a brightness, a color, and a blinking frequency of the visible warning.

10. The system of claim 1, wherein the user-wearable warning device includes a plurality of spaced apart warning devices.

11. The system of claim 10, wherein the processing circuit is configured to selectively provide the warning using a portion of the plurality of spaced apart warning devices to indicate the direction.

12. The system of claim 10, wherein at least a portion of the plurality of spaced apart warning devices are spaced apart and coupled to a helmet configured to be worn by the user.

13. The system of claim 10, wherein the plurality of spaced apart warning devices are included in at least one of a torso pad, a shoulder pad, a knee pad, and a thigh pad.

14. A proximity sensing and warning system, comprising:

a processing circuit configured to:

receive first proximity data regarding a proximity of a user to an object;

control operation of a wearable warning device to provide an output to the user based on the first proximity data, the output including an indication of the proximity of the user to the object;

receive second proximity data regarding a change in the proximity of the user to the object; and control operation of the wearable warning device to provide a modified output to the user based on the second proximity data, the modified output including an indication of the change in the proximity of the user to the object;

wherein the processing circuit is either:

(i) positioned remote from and does not move with the user; or (ii) worn by the user and configured to receive at least one of the first proximity data and the second proximity data directly from a sensor.

15. The system of claim 14, wherein the proximity comprises at least one of a distance between the user and the object, a direction between the user and the object, a closing speed between the user and the object, and a predicted impact time between the user and the object.

16. The system of claim 14, wherein the output includes an indication of at least one of a direction from the user toward the object, a distance between the user and the object, a closing speed between the user and the object, and a predicted impact time between the user and the object.

17. The system of claim 14, wherein the modified output differs in at least one of a frequency, an amplitude, a pitch, a volume, a brightness, and a color relative to the output.

18. The system of claim 14, wherein the processing circuit is configured to provide the modified output based on at least one of a change in velocity, a change in distance, and a change in direction of the object relative to the user.

19. The system of claim 14, wherein the wearable warning device includes a plurality of spaced apart warning devices.

20. The system of claim 19, wherein the processing circuit is configured to selectively provide the warning using a portion of the plurality of spaced apart warning devices to indicate a direction from the user toward the object.

21. The system of claim 19, further comprising the sensor, wherein the sensor is configured to acquire the at least one of the first proximity data and the second proximity data.

22. The system of claim 21, wherein the sensor is external to the user.

23. The system of claim 21, wherein the sensor is configured to be worn by the user.

24. A directional indicator system, comprising:

a remote device positioned remotely from and that does not move with a user, the remote device configured to provide data regarding a desired movement of the user;

a wearable output device configured to be worn by the user and configured to provide an indication including at least one of a haptic indication, an audible indication, and a visual indication to the user; and a processing circuit configured to receive the data and control operation of the wearable output device to indicate the desired movement of the user to prevent an impact with an object.

25. The system of claim 24, wherein the desired movement includes at least one of a direction of movement, a speed of movement, and a portion of the user to be moved.

26. The system of claim 24, wherein the wearable output device includes a plurality of spaced apart output devices.

27. The system of claim 26, wherein the processing circuit is configured to selectively actuate a portion of the plurality of spaced apart output devices to provide the indication.

28. The system of claim 24, wherein the indication includes the haptic indication, and wherein the desired movement corresponds to at least one of a frequency and an amplitude of the haptic indication.

29. The system of claim 24, wherein the indication includes the audible indication, and wherein the desired movement corresponds to at least one of a pitch and a volume of the audible indication.

30. The system of claim 24, wherein the indication includes the visual indication, and wherein the desired movement corresponds to at least one of a brightness, a color, and a blinking frequency of the visual indication.

31. The system of claim 24, wherein the processing circuit is configured to be worn by the user.

* * * * *